United States Patent [19]

Kobayashi et al.

[11] Patent Number: 4,588,930

[45] Date of Patent: May 13, 1986

[54] DEVICE FOR CORRECTING AN IMAGE ON A PICTURE TUBE HAVING IN-LINE ELECTRON GUNS AND A COIL ASSEMBLY FOR THE DEVICE

[75] Inventors: Toshio Kobayashi, Noda; Hideo Hishiki, Iwai, both of Japan

[73] Assignee: Victor Company of Japan, Limited, Japan

[21] Appl. No.: 735,353

[22] Filed: May 17, 1985

Related U.S. Application Data

[63] Continuation of Ser. No. 387,434, Jun. 11, 1982, abandoned.

[30] Foreign Application Priority Data

Jun. 14, 1981 [JP] Japan ..... 56-91275
Jul. 17, 1981 [JP] Japan ..... 59-111650
Jan. 7, 1982 [JP] Japan ..... 57-769

[51] Int. Cl.[4] ..... H01J 29/70
[52] U.S. Cl. ..... 315/400; 315/368
[58] Field of Search ..... 315/368, 400; 335/210, 335/212, 213; 313/412, 426, 427, 428, 433

[56] References Cited

U.S. PATENT DOCUMENTS 3,732,458 5/1973 Wolber ..... 315/400
3,854,108 12/1974 Horie et al. ..... 335/210
4,393,361 7/1983 Horton ..... 335/210
4,445,101 4/1984 Kobayashi et al. ..... 335/212

*Primary Examiner*—Theodore M. Blum
*Assistant Examiner*—David Cain
*Attorney, Agent, or Firm*—Lowe, Price, Leblanc, Becker & Shur

[57] ABSTRACT

In a deflecting yoke of an in-line type color picture tube, a pair of saturable reactors responsive to vertical deflection is connected to the horizontal deflecting coils so that horizontal deflection currents respectively flowing in two horizontal deflecting coils are controlled differentially in accordance with the degree of the vertical deflection, thereby minimizing raster distortion. Each of the saturable reactors may comprise a series connection of two coils connected to the vertical deflecting coils, and another series connection of two coils connected to the horizontal deflecting coils. The first-mentioned series connection may be omitted by positioning the second-mentioned series connection so that leakage flux from the vertical deflecting coils can be picked up. The core or cores of each of the saturable reactors are magnetically biased by a permanent magnet. A single disk-like magnet may be rotatably held to be in contact with two parallel cores so that rotation of the magnet results in change in impedance of the reactor.

33 Claims, 54 Drawing Figures

DEFLECTION TO SCREEN TOP

DEFLECTION TO SCREEN BOTTOM

DEVICE FOR CORRECTING AN IMAGE ON A PICTURE TUBE HAVING IN-LINE ELECTRON GUNS AND A COIL ASSEMBLY FOR THE DEVICE

This is a continuation of application Ser. No. 387,434 now abandoned.

BACKGROUND OF THE INVENTION

This invention relates generally to color picture tubes having three electron guns placed in line, and more particularly, the present invention relates to an improvement on a deflecting yoke of such a picture tube.

As is well known, each of the three electron beams emitted from red, green and blue electron guns of a picture tube used in a color TV set or a color display is required not only to be focussed but also to be converged at the phosphor screen. In a conventional color picture tube having three electron guns, which are arranged in a regular triangle or delta form, vertical and horizontal deflection magnetic fields are uniformly arranged for the three electron beams, and a convergence adjusting device for controlling the convergence of the three electron beams on the phosphor screen is employed so that the three electron beams are satisfactorily converged at any points on the phosphor screen. However, as the tendency of increasing the deflecting angle becomes more pronounced, it has been found that the conventional dynamic convergence assembly cannot achieve satisfactory dynamic convergence for corner portions of the screen. In order to solve this problem, many techniques and inventions have been developed hitherto as described in Japanese Patent Publication No. 52-33449 and others.

In the conventional color picture tubes having three electron guns which are arranged in a regular triangle form, utilization of a convergence adjustment device is essential for effecting dynamic convergence, and therefore it has been difficult to reduce the manufacturing cost.

Recently, a picture tube having three electron guns arranged in line in which self-convergence is effected has been provided, where the dynamic convergence of the three electron beams from the in-line electron guns is automatically performed by a pincushion horizontal deflecting magnetic field made by a pair of horizontal deflecting coils of a deflecting yoke, and by a barrel the vertical deflecting magnetic field made by a pair of vertical deflecting coils of the deflecting yoke. According to this technique, since no convergence adjusting device is needed, the circuit arrangement can be simplified while cost reduction can be readily achieved, and thus this technique has been widely adopted to various devices using a color picture tube.

In the above-mentioned in-line type picture tube using the self-convergence system, the positional relationship between the magnetic field and the electron beams is changed by the horizontal and vertical deflection magnetic field made by the deflecting yoke attached to the picture tube so as to obtain a satisfactory state of convergence with the axes of the deflection magnetic field and the electron beams being aligned. However, when the deflection angle is as large as 90 degrees, there arises a problem that satisfactory state of convergence cannot be obtained. Namely, when it is intended to obtain a magnetic field distribution of the deflecting field so that pincushion distortion and barrel distortion are minimized, a conventional way of adjustment called neck-swinging adjustment, in which the open portion at the front of the deflecting yoke is moved up and down and left and right with the neck thereof fixed, cannot provide sufficient convergence.

When it is tried to improve misconvergence of positive crossing at the top and bottom of raster in a 90-degree deflection tube of relatively small size, such as 12 or 14-in, by changing the magnetic field distribution of the deflecting yoke, the reproduced image will deteriorate due to pincushion distortion at the top and bottom of the raster.

Since it is difficult to form a deflection magnetic field having a magnetic field distribution, with which both the form of raster and the state of dynamic convergence are brought into satisfactory condition as the fact that distortion occurs in raster when the magnetic field distribution of the deflecting yoke is changed to obtain satisfactory convergence, in conventional in-line type color picture tubes of small size, such as 12 or 14-in, a pincushion distortion compensating circuit has been employed for compensating for the pincushion distortion which occurs at the top and bottom of raster, although it resulted in increase in cost.

However, in an in-line type color picture tube used for graphic display, character display or the like in which it is required to change the scanning frequency, the pincushion distortion compensating circuit has to be adjusted in accordance with the change of the scanning frequency. Although such adjustment may be manually performed, it is very troublesome to do so, while it is also inconvenient for the user. When a circuit for automatically performing such adjustment is added to the pincushion distortion compensating circuit, it results in a high manufacturing cost.

Although a technique of attaching permanent magnets to the top and bottom of the deflecting yoke has been proposed for the improvement of the pincushion distortion and convergence, this technique cannot be applied to an in-line type color picture tube having dot type or perforated shadow-mask, which are used for providing images of high precision, because satisfactory purity cannot be obtained due to the use of the above-mentioned magnets.

On the other hand, in an in-line type picture tube of large size, such as 22 to 26-in, misconvergence of so called negative-crossing occurs on the convergence of electron beams at the top and bottom of the raster, and this raster distortion and convergence cannot be satisfactorily improved, lowering the quality of the reproduced images.

Furthermore, depending on the combination of a picture tube and a deflecting yoke, a large deviation or misconvergence of positive crossing occurs at a middle portion on the reproduced image, where a portion between the top and horizontal center line or between the bottom and the horizontal center line is meant by "middle portion". When the amount of deviation in convergence is greater at the middle portion between the top and the center or between the bottom and the center than that at the top or bottom, satisfactory convergence cannot be expected when conventional countermeasure has been applied.

SUMMARY OF THE INVENTION

The present invention has been developed in order to remove the above-described drawbacks inherent to the conventional in-line type picture tube.

It is, therefore, an object of the present invention to provide a device for correcting an image on a color picture tube with which misconvergence is effectively corrected without employing a complex circuit arrangement.

According to a feature of the present invention a pair of saturable reactors are respectively connected in series with horizontal deflecting coils of the deflecting yoke where the impedances of the saturable reactors are arranged to vary in accordance with the degree of the vertical deflection. Permanent magnets are used to apply D.C magnetic bias to cores of coils of the saturable reactors, and the position of the magnets may be manually adjusted so that impedance of two coils thereof are changed.

In accordance with the present invention there is provided a device for correcting an image on a picture tube for use with an in-line type color picture tube of self-convergence system, comprising first and second saturable reactors respectively connected in series with each of horizontal deflecting coils of the deflecting yoke of the picture tube, the deflecting yoke also having two vertical deflecting coils, each of the first and second saturable reactors being arranged so that the impedance thereof changes in accordance with the degree of the vertical deflection effected by the vertical deflecting coils.

In accordance with the present invention there is also provided a coil assembly comprising: first and second coils respectively wound around individual cores which are substantially arranged in parallel, the first and second coils being electrically connected to each other; and a permanent magnet rotatably supported so that the magnet is in contact with both the cores of the first and second coils.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Prior to describing the preferred embodiments of the present invention, the above-described conventional technique and its drawbacks will be described for a better understanding of the present invention.

Figure 1:
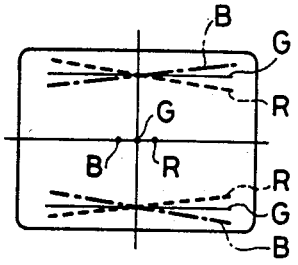
FIGS. 1 to 3 show various states of misconvergence which occurs on a TV screen.
Figure 2:
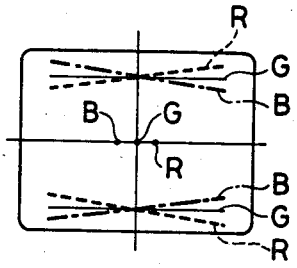
Figure 3:
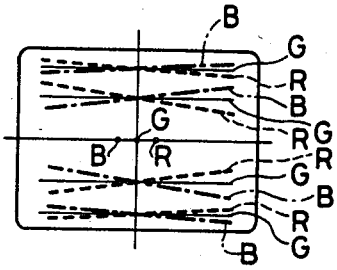

FIGS. 1 to 3 show schematically various states of misconvergence on a picture tube screen. FIG. 1 shows positive crossing; FIG. 2 shows negative-crossing; and FIG. 3 shows large positive crossing occured in the middle portion between the top and the horizontal center line shown and between the bottom and the horizontal center line of raster.

Figure 4:
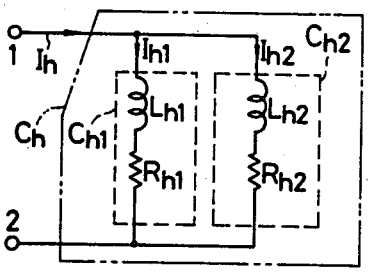
FIG. 4 PRIOR ART
FIG. 4 is a circuit diagram of a conventional deflecting yoke.

FIG. 4 is an equivalent circuit diagram of a pair of horizontal deflecting coils $Ch_1$ and $Ch_2$ of a conventional deflecting yoke which also has a pair of vertical deflecting coils (not shown). The pair of deflecting coils $Ch_1$ and $Ch_2$ are connected in parallel. The shown circuit comprises two terminals 1 and 2 for receiving horizontal deflection output, which is fed from an unshown horizontal output circuit. The combination of the pair of deflecting coils $Ch_1$ and $Ch_2$, which may be referred to as a horizontal deflecting coil assembly, is represented by a reference Ch.

Each of the horizontal deflecting coils $Ch_1$ and $Ch_2$ comprises an inductance component Lh1, Lh2 and resistance component Rh1, Rh2. When the terminals 1 and 2 are supplied with horizontal output, a horizontal deflection current flowing through the horizontal deflecting coil assembly Ch is branched off in accordance with the impedances of the respective horizontal deflecting coils $Ch_1$ and $Ch_2$.

Since the horizontal deflecting coils $Ch_1$ and $Ch_2$ of the horizontal deflecting coil assembly Ch are manufactured usually so that their impedances are equal to each other, the amount of horizontal deflecting currents $Ih_1$ and $Ih_2$ respectively flowing through the horizontal deflecting coils $Ch_1$ and $Ch_2$ are identical.

According to the present invention, the individual horizontal deflecting currents $Ih_1$ and $Ih_2$ respectively flowing through the pair of horizontal deflecting coils $Ch_1$ and $Ch_2$ are modified so that these currents periodically change in accordance with the degree of the vertical deflection. Namely, the magnetic field distribution for horizontal deflection is changed as time goes so that deviation in convergence is corrected or compensated for.

Figure 5:
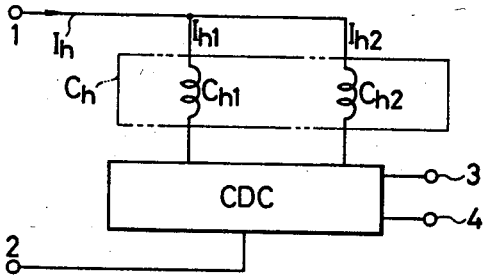
FIG. 5 is a schematic diagram of the device according to the present invention.

FIG. 5 shows a schematic diagram of a circuit arrangement for the horizontal deflecting coils $Ch_1$ and $Ch_2$ of a horizontal deflecting coil assembly Ch. The circuit of FIG. 5 is arranged to receive horizontal deflecting current from terminals 1 and 2 in the same manner as the conventional circuit of FIG. 4. Another terminals 3 and 4 are provided for receiving a signal which varies at the vertical deflecting period. A circuit designated at CDC, which is connected to the terminals 3 and 4 and also to the horizontal deflecting coils $Ch_1$ and $Ch_2$, is a current control circuit used for differentially changing the individual currents flowing through the horizontal deflecting coils $Ch_1$ and $Ch_2$ in accordance with the vertical deflection. The current control circuit CDC is arranged such that the individual currents flowing through the horizontal deflecting coils $Ch_1$ and $Ch_2$ are so controlled that necessary magnetic field distribution is obtained with which misconvergence does not occur in the reproduced images of the color picture tube of the type of in-line electron guns.

Suppose that misconvergence occurred in an in-line type color picture tube, to which self-convergence system is adopted, is of positive crossing as shown in FIG. 1. In this case, the magnetic field of the horizontal deflection for correcting the misconvergence should vary as shown in FIG. 6.

Figure 6:
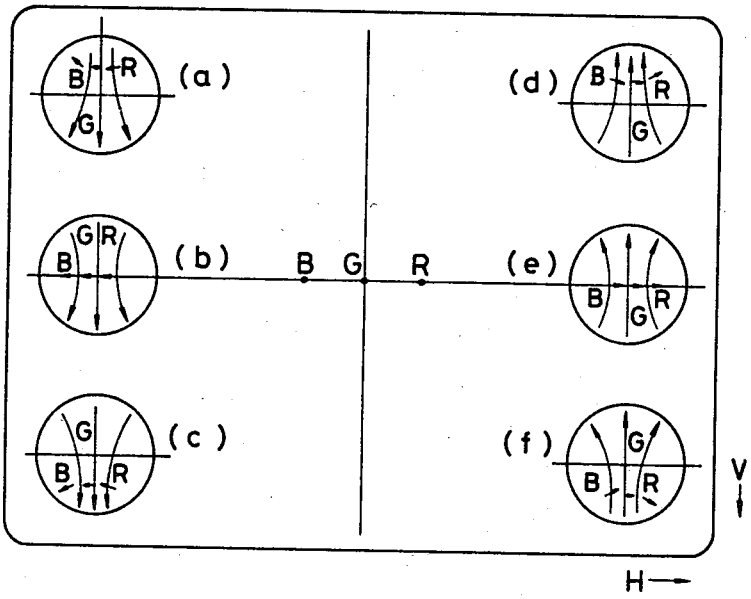
FIG. 6 is an explanatory diagram of magnetic field distribution used for corrrecting misconvergence of positive crossing.

Namely, misconvergence of electron beams from the red, green and blue electron guns will be corrected when the horizontal deflection magnetic field varies in accordance with the period of the vertical deflection as shown in FIG. 6. This magnetic field distribution change can be obtained by changing the currents $Ih_1$ and $Ih_2$ respectively flowing through the horizontal deflecting coils $Ch_1$ and $Ch_2$ such that:

$$Ih_1 > Ih_2 \quad (1)$$

for the upper half of raster on the screen;

$$Ih_1 = Ih_2 \quad (2)$$

for the center portion of raster; and $$Ih_1 < Ih_2 \quad (3)$$

for the lower half of raster.

In the above, the upper half and lower half means the portions bisected by the horizontal center line (see FIGS. 1 to 3).

On the contrary, if the state of misconvergence is of a negative crossing as shown in FIG. 2, the distribution of the horizontal deflection magnetic field should change by controlling the individual currents $Ih_1$ and $Ih_2$ respectively flowing through the horizontal deflecting coils $Ch_1$ and $Ch_2$ such that:

$$Ih_1 < Ih_2 \quad (4)$$

for the upper half of raster on the screen;

$$Ih_1 = Ih_2 \quad (5)$$

for the center portion of raster; and $$Ih_1 > Ih_2 \quad (6)$$

for the lower half of raster.

Furthermore, in the case that misconvergence occurs in the manner of FIG. 3, namely, when positive crossing occurs with maximum deviation at the middle portion between the top and the center and between the bottom and the center, the distribution of the horizontal deflection magnetic field should change by controlling the individual currents $Ih_1$ and $Ih_2$ respectively flowing through the horizontal deflecting coils $Ch_1$ and $Ch_2$ such that the currents $Ih_1$ and $Ih_2$ flowing through the horizontal deflecting coils $Ch_1$ and $Ch_2$ are controlled so that the above Eqs. (1) to (3) are satisfied for the top, the center portion and the bottom of the screen. Simultaneously, the currents $Ih_1$ and $Ih_2$ for the middle portion between the top and the center of the screen is controlled to satisfy Eq. (1), while the current $Ih_1$ is made greater than that for the top, and the current $Ih_2$ is made smaller than that for the top. Similarly, the currents $Ih_1$ and $Ih_2$ for the other middle portion between the bottom and the center of the screen are controlled to also satisfy Eq. (3), while the current $Ih_1$ is made smaller than that for the bottom, and the current $Ih_2$ is made greater than that for the bottom.

Since the change of the currents respectively flowing through the horizontal deflecting coils $Ch_1$ and $Ch_2$ of the horizontal deflecting coil assembly Ch is controlled by the current control circuit CDC of FIG. 5, the current control circuit CDC should be constructed so that it can control the currents $Ih_1$ and $Ih_2$ in a way suitable for any state of misconvergence on the picture tube screen.

Any structure may be applied to the current control circuit as long as the currents $Ih_1$ and $Ih_2$ to be fed to the horizontal deflecting coils $Ch_1$ and $Ch_2$ are controlled in a given manner in accordance with the degree of the vertical deflection. For instance, the current control circuit CDC may be constructed such that impedance of each of the impedance elements respectively connected in series to the horizontal deflecting coils $Ch_1$ and $Ch_2$ varies in a given manner in accordance with the degree of the vertical deflection. Alternatively, the currents $Ih_1$ and $Ih_2$ may be controlled by an electronic circuit which is designed to control the same in accordance with the degree of the vertical deflection. Furthermore, a power source which supplies horizontal deflecting coils $Ch_1$ and $Ch_2$ with the horizontal deflection currents may be arranged such that the currents change in a given manner in accordance with the degree of vertical deflection.

Figure 7:
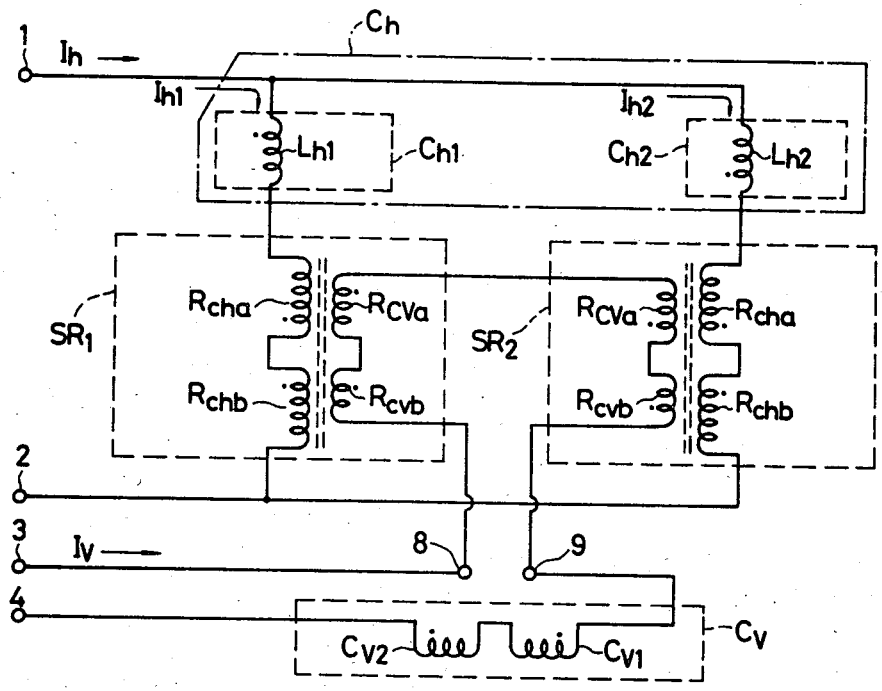
FIG. 7 is a detailed circuit diagram of an embodiment of the device of FIG. 6.

FIG. 7 shows an embodiment of the circuit used in the device acording to the present invention. In the circuit of FIG. 7, are used saturable reactors $SR_1$ and $SR_2$ for constituting the current control circuit CDC of FIG. 5. In FIG. 7, two coils indicated at the references $Cv_1$ and $Cv_2$ are vertical deflecting coils of a vertical deflecting coil assembly Cv which is used in combination with the horizontal deflecting coil assembly Ch to constitute a deflecting yoke.

Figure 8:
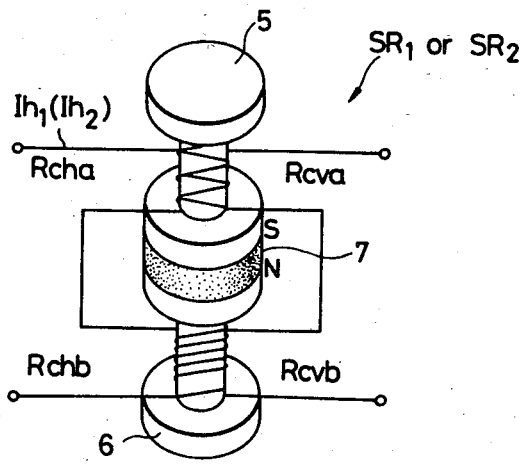
FIG. 8 is perspective view of the saturable reactor used in the device of FIG. 7.

Each of the saturable reactors $SR_1$ and $SR_2$ is formed as shown in FIG. 8. Since both saturable reactors $SR_1$ and $SR_2$ are formed in identical manner, description will be made on one of them. The saturable reactor $SR_1$ comprises drum cores 5 and 6 made of a ferrite, a permanent magnet 7 for applying a D.C. bias to the drum cores 5 and 6, and coils Rcha, Rchb, Rcva and Rcvb wound around the drum cores 5 and 6. Namely, each saturable reactor $SR_1$ or $SR_2$ has four coils as shown in the circuit diagram of FIG. 7. The permanent magnet 7 is interposed between flanges of the two cores 5 and 6 which are arranged coaxially.

The coil Rcha is connected in series to the coil Rchb where the directions of winding of these coils Rcha and Rchb are opposite to each other. One end of the series connection of the coils Rcha and Rchb is connected to the horizontal deflecting coil $Ch_1$ or $Ch_2$, while the other end is connected to the terminal 2. The remaining two coils Rcva and Rcvb are also connected in series to each other where the directions of winding thereof are identical. The coil Rcva of the saturable reactor $SR_1$ is connected to the other coil Rcva of the other saturable reactor $SR_2$ so that these two coils are connected in series. The coils Rcvb of the two saturable reactors $SR_1$ and $SR_2$ are respectively connected to terminals 8 and 9 so that two coils Rcva and Rcvb of the saturable reactor $SR_1$ and the other two coils Rcva and Rcvb of the other saturable reactor $SR_2$ are connected in series between the terminals 8 and 9.

The embodiment of FIG. 7 is designed to compensate for misconvergence of positive crossing (see FIG. 1). In detail, in the case of compensating for misconvergence of positive crossing, the coil Rcvb of the saturable reactor $SR_1$ is connected to the terminal 8, while the other coil Rcvb of the other saturable reactor $SR_2$ is connected to the terminal 9 as shown in FIG. 7. However, when it is intended to compensate for misconvergence of negative crossing (see FIG. 2), the coil Rcvb of the saturable reactor $SR_1$ is connected to the terminal 9, while the other coil Rcvb of the other saturable reactor $SR_2$ is connected to the terminal 8.

The circuit of FIG. 7 operates as follows. The terminals 1 and 2 are connected to an unshown horizontal deflection output circuit as described before, and thus a horizontal deflection current $Ih_1$ flows via the terminal 1 → the horizontal deflecting coil $Ch_1$ → the coils Rcha and Rchb of the saturable reactor $SR_1$ → the terminal 2, while another horizontal deflection current $Ih_2$ flows via the terminal 1 → the horizontal deflecting coil $Ch_2$ → the coils Rcha and Rchb of the saturable reactor $SR_2$ → the terminal 2.

The drum cores 5 and 6 of each of the saturable reactors $SR_1$ and $SR_2$ are arranged to receive a D.C. magnetic bias by the permanent magnet 7 as described in the above, while the coils Rcva and Rcvb respectively wound around the drum cores 5 and 6 are arranged such that a vertical deflection current Iv flows via the terminal 3 → the terminal → 8 the coils Rcvb and Rcva of the saturable reactor $SR_1$ → the coils Rcva and Rcvb of the saturable reactor $SR_2$ → the terminal 9 → the vertical deflecting coils $Cv_1$ and $Cv_2$ → the terminal 4. As a result, the impedance of one of the saturable reactors $SR_1$ and $SR_2$ increases while the impedance of the other decreases.

Since the vertical deflection current Iv varies such that it goes positive and negative centering zero-current point, the state of the above-mentioned increase and decrease in the impedances of the saturable reactors $SR_1$ and $SR_2$ for the upper half of the screen is opposite to that for the lower half of the screen.

In the circuit arrangement of FIG. 7, the relationship between the impedances $Z_1$ and $Z_2$ of the saturable reactors $SR_1$ and $SR_2$ for the upper half of the screen is expressed by $Z_1 < Z_2$; for the center portion of the screen, by $Z_1 = Z_2$; and for the lower half of the screen, by $Z_1 > Z_2$.

In this way, the impedance of each of the saturable reactors $SR_1$ and $SR_2$, which are respectively connected in series with the horizontal deflecting coils $Ch_1$ and $Ch_2$, varies in accordance with the degree of vertical deflection, and therefore, the current $Ih_1$ flowing through the horizontal deflecting coil $Ch_1$ and the other current $Ih_2$ flowing through the horizontal deflecting coil $Ch_2$ vary in accordance with the degree of vertical deflection as already described in connection with Eqs. (1) to (3).

Accordingly, if the amount of variation in each of the impedances $Z_1$ and $Z_2$ of the saturable reactors $SR_1$ and $SR_2$ is suitably arranged, misconvergence of positive crossing can be corrected by the circuit arrangement of FIG. 7. Similarly, misconvergence of negative crossing may also be corrected with the terminals 8 and 9 connected in a manner opposite to FIG. 7.

Now detailed operation will be described taking a case for correcting misconvergence of positive crossing as an example. It is to be noted that the horizontal deflecting coils $Ch_1$ and $Ch_2$ and the saturable reactors $SR_1$ and $SR_2$ are designed such that their inductance component L and resistance component R have a relationship of $WL >> R$, wherein W is frequency in radians, and thus the current flowing in each of these circuits is substantially dependent on the value of its inductance component L. Therefore, it is necessary to pay attention to only the value of inductances of these circuits. Let us assume that the necessary difference in inductances between the horizontal deflecting coils $Ch_1$ and $Ch_2$ for correcting misconvergence of positive crossing is expressed in terms of Ld. This difference should be made by the difference in inductances between the saturable reactors $SR_1$ and $SR_2$ because the inductances respectively inherent to the horizontal deflecting coils $Ch_1$ and $Ch_2$ are equal to each other.

In order to satisfactorily compensate for the misconvergence of positive crossing such as shown in FIG. 1, it is necessary to change the inductances $L_{R1}$ and $L_{R2}$ of the saturable reactors $SR_1$ and $SR_2$ so that there occurs a difference Ld therebetween as:

$$Ld = |L_{R1} - L_{R2}| \tag{7}$$

Figure 9A:
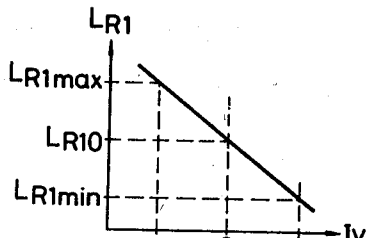
Figure 9B:
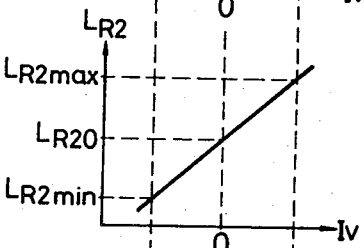
Figure 9C:
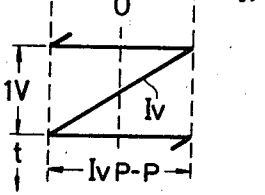

Namely, the inductances $L_{R1}$ and $L_{R2}$ of the saturable reactors $SR_1$ and $SR_2$ should vary as shown in FIGS. 9A and 9B in accordance with the vertical deflection current Iv. FIG. 9A shows the inductance variation of the saturable reactor $SR_1$, while FIG. 9B shows the inductance variation of the other saturable reactor $SR_2$. FIG. 9C shows the waveform of the vertical deflection current Iv which flows through the coils Rcva and Rcvb of the saturable reactors $SR_1$ and $SR_2$.

In FIGS. 9A and 9B, the references $L_{R10}$ an $L_{R20}$ are inductances of the saturable reactors $SR_1$ and $SR_2$ when the vertical deflection current Iv is zero; $L_{R1max}$ and $L_{R2max}$ are maximum inductances of the saturable reactors $SR_1$ and $SR_2$; and $L_{R1min}$ and $L_{R2min}$ are minimum inductances of the same. The values of the above-mentioned various inductances have the relationships as follows:

$$L_{R1min} - L_{R10} = -Ld/2$$

$$L_{R2max} - L_{R20} = Ld/2$$

$L_{R1max}-L_{R10}=Ld/2$ $L_{R2min}-L_{R20}=-Ld/2$

Figure 10A:
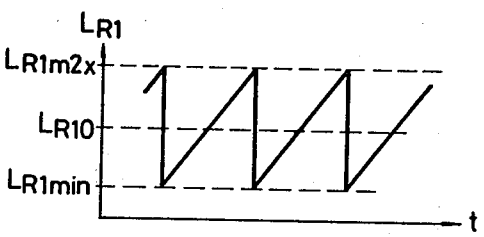
FIGS. 9A to 9C, 10A to 10C, 11A to 11C, 12A to 12C, and 13A to 13C are waveform charts useful for understanding the operation of the device of FIG. 7.
Figure 10B:
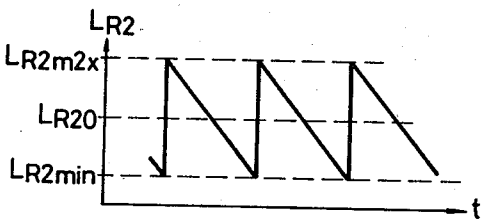
Figure 10C:
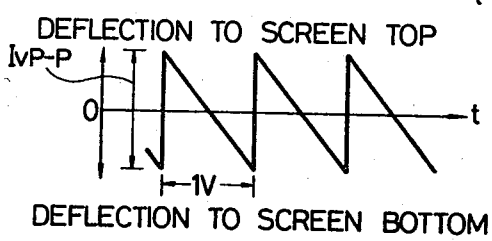

FIGS. 10A and 10B show the variation of the inductances of the saturable reactors $SR_1$ and $SR_2$ on time base; and FIG. 10C shows the waveform of the vertical deflection current Iv.

When the inductances of the pair of saturable reactors $SR_1$ and $SR_2$ vary from $L_{R10}$ and $L_{R20}$, the impedances $Z_1$ and $Z_2$ of the pair of horizontal deflecting coils $Ch_1$ and $Ch_2$ have following relationships depending on the portion on the screen:

$Z_1=Z_2$ for the upper portion;

$Z_1<Z_2$ for the upper half and $Z_1>Z_2$ for the lower half.

Therefore, the relationship between the current $Ih_1$ flowing through the horizontal deflecting coil $Ch_1$ and the current $Ih_2$ flowing through the horizontal deflecting coil $Ch_2$ satisfies Eqs. (1) to (3) to satisfactorily compensate for misconvergence of positive crossing.

According to experiments, in an in-line type color picture tube of 12-in and 90 degrees deflection angle, when a reactor showing an inductance difference expressed by $|LR1-LR20|=80\ \mu H$, is connected to a deflecting yoke comprising horizontal deflecting coils $Ch_1$ and $Ch_2$ having an inductance of 1.5 mH and a vertical deflecting coil Cv having an inductance of 100 mH, vertical misconvergence could be corrected as much as 1.1 mm, so that satisfactory reproduced images could be obtained without suffering from raster distortion.

The above description has been made in connection with a case for correcting misconvergence of positive crossing, and it will be readily understood that misconvergence of negative crossing can also be corrected in a similar manner. Therefore, description of correction of misconvergence of negative crossing is omitted.

Referring to FIGS. 11A to 11C, 12A to 12C and 13A to 13c, the operation of the circuit of FIG. 7 will be described in connection with the case for correcting misconvergence of FIG. 3.

Figure 12A:
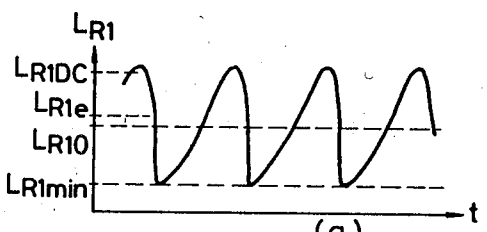
Figure 12B:
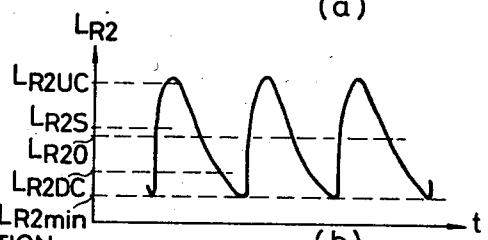
Figure 12C:
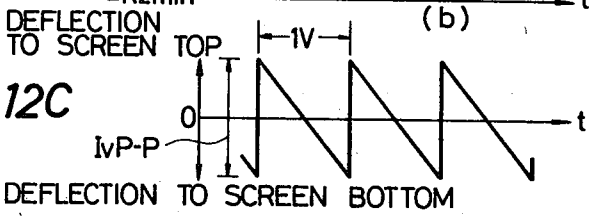
Figure 11A:
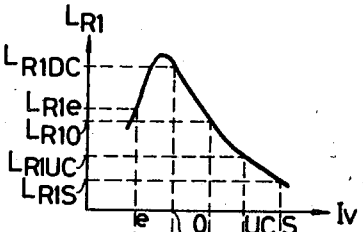
Figure 11B:
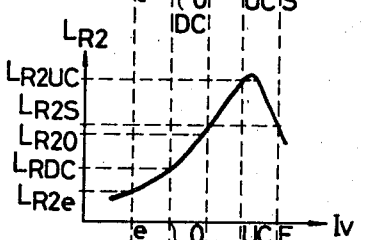
Figure 11C:
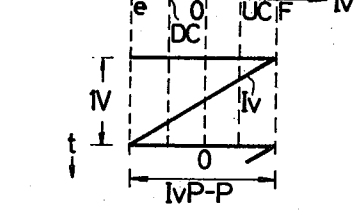
Figure 13A:
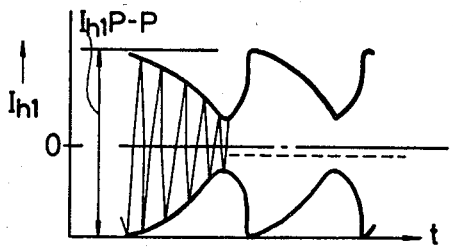
Figure 13B:
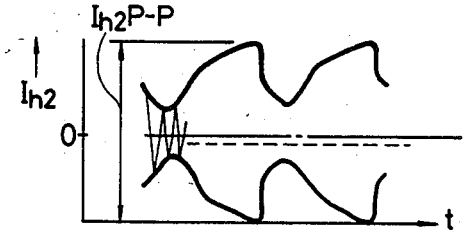
Figure 13C:
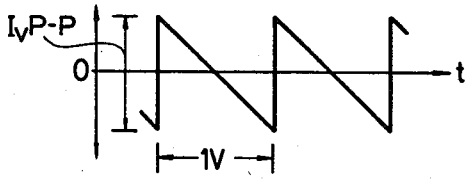

FIGS. 11C, 12C and 13C are waveform charts of the vertical deflection current Iv which flows through the coils Rcva and Rcvb of the saturable reactors $SR_1$ and $SR_2$; FIGS. 11A and 12A are characteristic graphs of the inductance variation in the saturable reactor $SR_1$; FIGS. 11B and 12B are characteristic graphs of the inductance variation in the saturable reactor $SR_2$; and FIGS. 13A and 13B are waveform charts of the horizontal deflection currents $Ih_1$ and $Ih_2$ respectively flowing through the horizontal deflecting coils $Ch_1$ and $Ch_2$.

In order to correct the misconvergence of FIG. 3, the inductances of the saturable reactors $SR_1$ and $SR_2$ should be changed as shown in FIGS. 11A, 11B, 12A and 12B in accordance with the degree of the vertical deflection. To this end, the intensity of magentic bias applied to the saturable reactors $SR_1$ and $SR_2$ by the permanent magnet 7 may be changed so that suitable magnetic bias is selected.

Misconvergence of the type of FIG. 3 may be satisfactorily corrected when the following two equations are satisfied:

$$|L_{R1UC}-L_{R2UC}|>|L_{R1S}-L_{R2S}| \quad (8)$$

$$|L_{R1DC}-L_{R2DC}|>|L_{R1e}-L_{R2e}| \quad (9)$$

wherein $L_{R1UC}$, and $L_{R2UC}$ are the inductances of the saturable reactors $SR_1$ and $SR_2$ when the electron beams are deflected to the middle portion between the center portion and the top of the screen;

$L_{R1S}$ and $L_{R2S}$ are the inductances of the saturable reactors $SR_1$ and $SR_2$ when the electron beams are deflected to the top of the screen;

$L_{R1DC}$, and $L_{R2DC}$ are the inductances of the saturable reactors $SR_1$ and $SR_2$ when the electron beams are deflected to the middle portion between the center portion and the bottom of the screen;

$L_{R1e}$ and $L_{R2e}$ are the inductances of the saturable reactors $SR_1$ and $SR_2$ when the electron beams are deflected to the bottom of the screen.

From the above, it will be understood that in the embodiment of FIG. 7, since the horizontal deflection currents flowing through the pair of horizontal deflecting coils $Ch_1$ and $Ch_2$ are differentially changed in accordance with the degree of the vertical deflection, misconvergence of positive or negative crossing can be effectively corrected without using a circuit for raster distortion compensation or a corrective magnet so that high-quality reproduced images can be obtained on the screen with raster distortion being minimized and without deteriorating purity.

Figure 14:
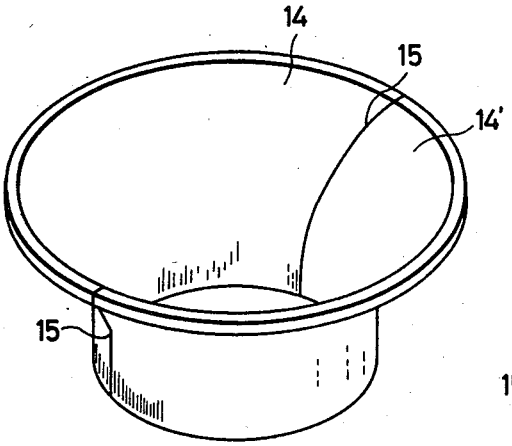
FIG. 14 is a perspective view of assembled cores of vertical deflecting coils.
Figure 15:
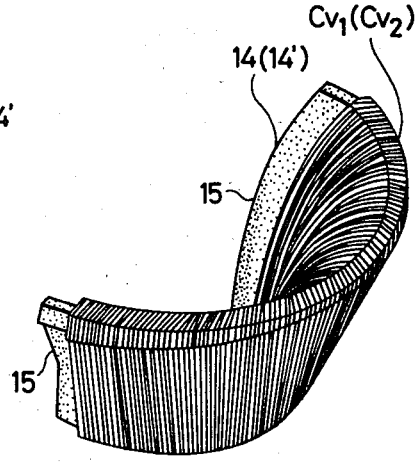
FIG. 15 is a perspective view of one of the vertical deflecting coils wound around one of the cores of FIG. 14.
Figure 16:
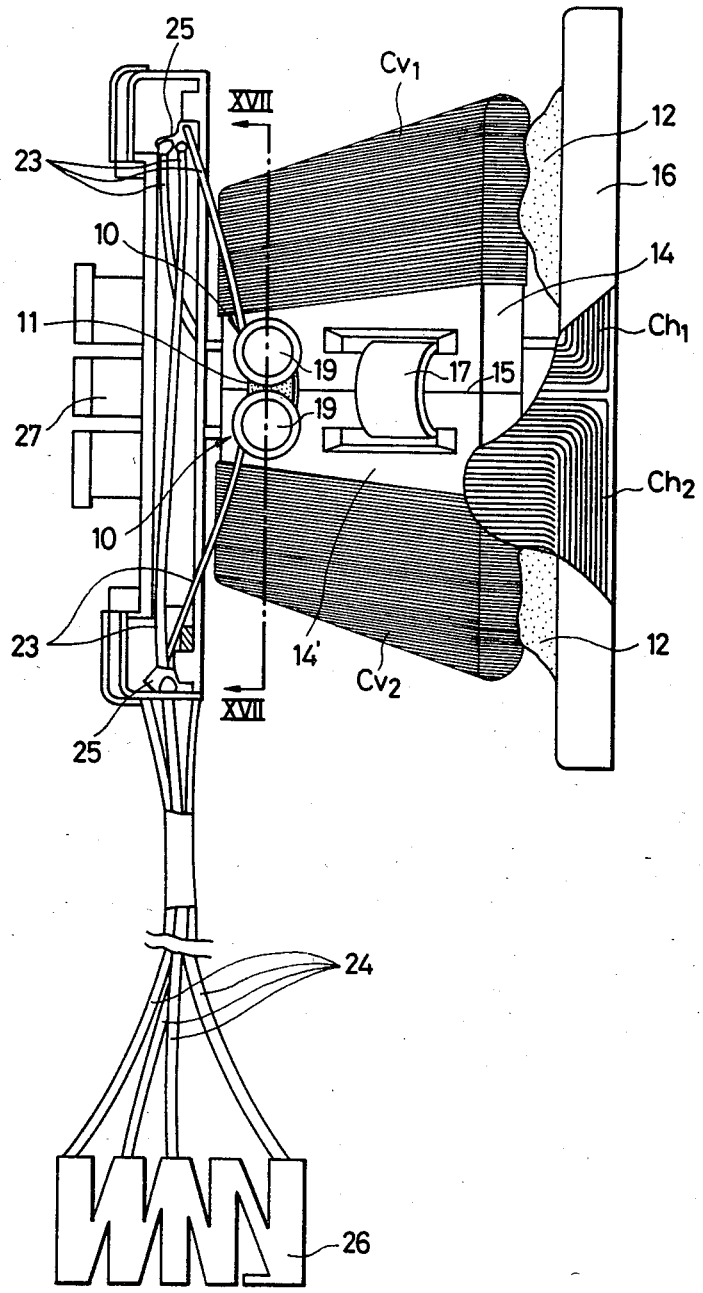
FIG. 16 is a side view of another embodiment of the device according to the present invention.
Figure 17:
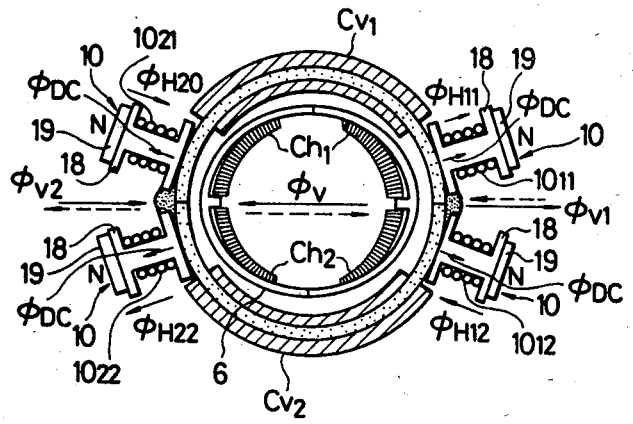
FIG. 17 is a cross-sectional view taken along the line X VII—X VII of FIG. 16.

Another embodiment of the device according to the present invention will be described with reference to FIGS. 14 to 17. A pair of vertical horizontal deflecting coils $Cv_1$ and $Cv_2$ are wound around a pair of cores 14 and 14' which are connected to each other at connecting sections 15 as shown in FIGS. 14 and 15. A pair of horizontal deflecting coils $Ch_1$ and $Ch_2$ are built in a separator 16 which is made of an insulating material such as a synthetic resin, where the separator 16 has a truncated conical shape. FIG. 16 is a side view of the deflecting yoke assembly used in this embodiment. The separator 16 having the horizontal deflecting coils $Ch_1$ and $Ch_2$ therein is telescopically engaged with the inside of the cores 14 and 14' which are fastened by a pair of clamps 17. The separator 16 is fixed, by means of an adhesive 22 such as hot-melt, to the vertical deflecting coils $Cv_1$ and $Cv_2$ wound around the cores 14 and 14'. FIG. 17 shows a cross-sectional view of the deflecting yoke assembly taken along the line X VII—X VII of FIG. 16.

The reference 10 indicates a coil assembly forming a reactor which is constructed in a manner different to that shown in FIGS. 7 and 8. The reactor comprises a drum core 18, around which coils connected to the horizontal deflecting coils $Ch_1$ and $Ch_2$ are wound, and a permanent magnet 19 14 attached to the drum core 18. The permanent magnet 19 is attached to one end of the drum core 18 having a shape of spool. As shown in FIG. 17, four coil assemblies 10 are respectively fixed to side surface of the cores 14 and 14' by means of an adhesive of an epoxy resin. Each of the drum cores 18 of the coil assemblies 10 has an open magnetic path. Use of such a core of open magnetic path is advantageous in view of productivity.

At the rear side of the separator 16, i.e. its neck side, is provided a terminal 25 at which lead wires 23 of respective coils are connected to external lead wires 24. The external lead wires 14 are equipped with a connector 26 at their ends for easy connection with a terminal provided on a printed circuit board or the like.

The separator 16 comprises a plurality of tongues 27 extending axially so that the deflecting yoke of FIG. 16 will be attached to a color picture tube with the tongues 27 tightened by a belt.

Figure 18:
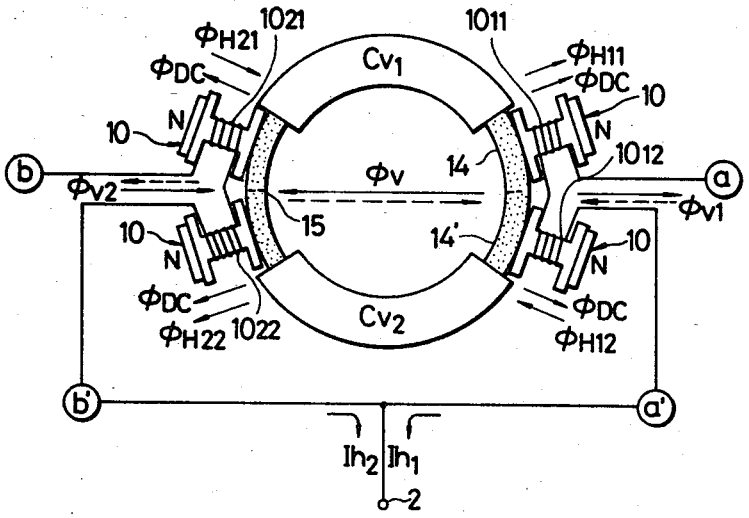
FIG. 18 is an explanatory view for the description of the operation of the device of FIGS. 16 and 17.
Figure 19:
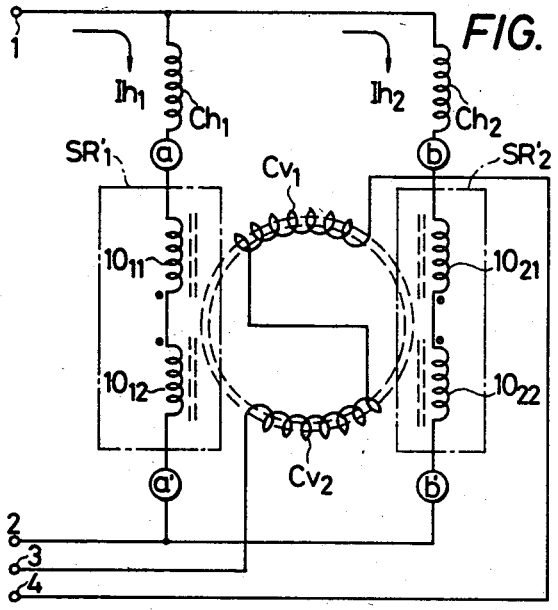
FIG. 19 is a circuit diagram of the device of FIGS. 16 and 17.

FIG. 18 schematically illustrates the deflecting yoke of FIGS. 5 and 6 for the description of the operation, and FIG. 19 is a circuit diagram of the deflecting yoke. Each of the four coil assemblies 10 has a coil $\mathbf{10}_{11}$, $\mathbf{10}_{12}$, $\mathbf{10}_{21}$ and $\mathbf{10}_{22}$. The coils $\mathbf{10}_{11}$ and $\mathbf{10}_{12}$ are connected in series so that their winding directions are opposite to each other. These coils $\mathbf{10}_{11}$ and $\mathbf{10}_{12}$ constitute a saturable reactor $SR_1'$ together with one of the vertical deflecting coils $Cv_1$ and $Cv_2$ as shown in FIG. 19. Similarly, the coils $\mathbf{10}_{21}$ and $\mathbf{10}_{22}$ are connected in series so that their winding directions are opposite to each other. These coils $\mathbf{10}_{21}$ and $\mathbf{10}_{22}$ constitute another saturable reactor $SR_2'$ together with one of the vertical deflecting coils $Cv_1$ and $Cv_2$. In other words, although the vertical deflecting coils $Cv_1$ and $Cv_2$ are not directly wound around any of the cores 18 of the coil assemblies 10, leakage flux from the vertical deflecting coils $Cv_1$ and $Cv_2$ flows into the cores 18 so that each coil assembly 10 functions as a saturable reactor $SR_1'$ or $R_2'$ as shown in FIG. 19. The magnetic flux from the vertical deflecting coils $Cv_1$ and $Cv_2$ are respectively indicated at the references $\phi$v1 and $\phi$v2. Since the leakage flux $\phi$v1 and $\phi$v2 from each of the vertical deflecting coils $Cv_1$ and $Cv_2$ appear at the connecting sections 15, the coil assemblies 10 are located on the core 14 of the vertical deflecting coils Cv in the vicinity of each of the connecting sections 15. With this arrangement, each of the coil assemblies 10 is responsive to the leakage flux $\phi$v1 or $\phi$v2.

Each of the permanent magnets 19 attached to the cores 18 is arranged such that D.C. magnetic bias $\phi$DC is given to each of the coil assemblies 10, which bias $\phi$DC has a direction extending radially outwardly from the cores 14 and 14' of the vertical deflecting coils $Cv_1$ and $Cv_2$. The coil $\mathbf{10}_{11}$ is connected in series to the upper horizontal deflecting coil $Ch_1$, while the coil $\mathbf{10}_{21}$ is connected in series to the lower horizontal deflecting coil $Ch_2$ as shown in FIG. 19.

Since the vertical deflection current Iv varies as time goes, the magnitude and direction of each of the leakage flux $\phi$v1 and $\phi$v2 change accordingly. Therefore, the inductance of each of the saturable reactors $SR_1'$ and $SR_2'$ changes in accordance with the degree of the vertical deflection in such a manner that there is a difference between the inductances of these saturable reactors $SR_1'$ and $SR_2'$. The change in inductance cuases the change in impedance of the circuit each connected in series to each of the horizontal deflecting coils $Ch_1$ and $Ch_2$, and thus the horizontal deflection currents $Ih_1$ and $Ih_2$ respectively flowing through the horizontal deflecting coils $Ch_1$ and $Ch_2$ change differentially in accordance with the degree of the vertical deflection.

The operation of the deflecting yoke of FIGS. 16 to 19 will be described taking an example of the case for correcting misconvergence of positive crossing. In order to correct such misconvergence the distribution of the horizontal deflection magnetic field should be changed from the beginning of vertical scanning (top of the screen) toward the end of vertical scanning (bottom of the screen) so that the vectors of the red, green and blue electron beams are corrected to compensate for the misconvergence. To this end the horizontal deflection magnetic field may be changed in the direction of vertical scanning (see an arrow V in FIG. 6) so that the vectors are changed as shown in (a), (b) and (c) of FIG. 6 at the beginning of horizontal scanning (left side of the screen) and as shown in (d), (e) and (f) of FIG. 6 at the end of horizontal scanning (right side of the screen). An arrow H indicates the direction of horizontal scanning. Therefore, the impedance of the circuit of the upper horizontal deflecting coil $Ch_1$ and the impedance of the circuit of the lower horizontal deflecting coil $Ch_2$ should be changed for obtaining the changing state magnetic field distribution as follows:

$$Z_1 = Z_2 \text{ for the upper half;} \quad (10)$$

$$Z_1 < Z_2 \text{ for the center portion; and} \quad (11)$$

$$Z_1 > Z_2 \text{ for the lower half} \quad (12)$$

To obtain the above relationships the inductances of the saturable reactors $SR_1'$ and $SR_2'$ are differentially changed by the vertical deflection current Iv.

Let us assume that the magnetic flux for the vertical deflection is expressed in terms of $\phi$v, and the aforementioned leakage fluxes $\phi$vl and $\phi$v2 are emitted outside the cores 14 and 14' in the vicinity of the dividing plane 15. Since the magnitude and direction of the leakage fluxes $\phi$vl and $\phi$v2 are both proportional to the magnetic flux $\phi$v, they also change depending on the change in the magnetic flux $\phi$v. The embodiment of FIGS. 16 to 19 utilizes this fact so that the inductances of the saturable reactors $SR_1'$ and $SR_2'$ are differentially changed.

This point will be described in detail. When the electron beams are deflected to the top of the screen, the directions of the vertical deflection magnetic flux and its leakage fluxes are indicated by a solid line in FIGS. 17 and 18. Therefore, the direction of the leakage flux $\phi$vl, which acts on the coils $\mathbf{10}_{11}$ and $\mathbf{10}_{12}$, and the direction of the D.C. magnetic bias $\phi$DC given to the coil assemblies 10 are identical in connection with two coil assemblies 10 for the upper portion, i.e. two coil assemblies 10 illustrated at the right in FIGS. 16 and 17. On the other hand, the direction of the leakage flux $\phi$v1, which acts on the coils $\mathbf{10}_{21}$ and $\mathbf{10}_{22}$, and the direction of the D.C. magnetic bias $\phi$DC given to the coil assemblies 10 are identical in connection with other two coil assemblies 10 for the lower portion, i.e. two coil assemblies 10 illustrated at the left in FIGS. 16 and 17. As a result, the saturable reactor $SR_1'$ is apt to be saturated compared to the other saturable reactor $SR_2'$ so that the inductance LR1' of the saturable reactor $SR_1'$ is smaller than that of the other saturable reactor $SR_2'$.

On the other hand, when the electron beams are deflected at the bottom or lower half of the screen, the direction of the vertical deflection magnetic flux $\phi$v is opposite to the above. Namely, the directions of the vertical deflection magnetic flux $\phi$v and the leakage fluxes $\phi$v1 and $\phi$v2 are indicated by the arrowed dotted line. Accordingly, the relationship between $\phi$v1, $\phi$DC, and the relationship between $\phi$v2 and $\phi$DC are both inverted from the above so that the saturable reactor $SR_2'$ is apt to be saturated compared to the other saturable reactor $SR_1'$, and thus the inductance of the saturable reactor $SR_2'$ is made smaller than that of the reactor $SR_1'$.

Figure 20A:
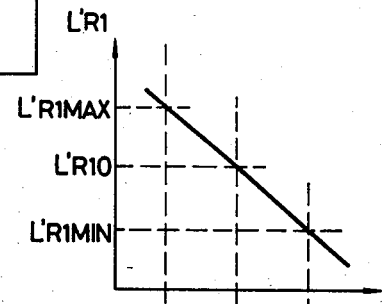
FIGS. 20A to 20C, 21, 22, 23A to 23C and 24 are explanatory diagrams for understanding the operation of the device of FIGS. 16 and 17.
Figure 20B:
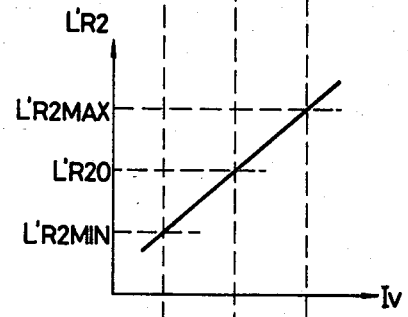
Figure 20C:
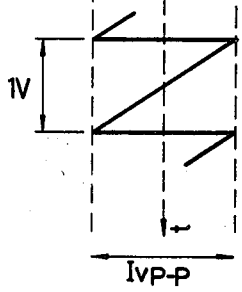

FIGS. 20A, 20B and 20C show the relationship between the time-dependent variation of the vertical deflection current Iv and the inductances $L_{R1}'$ and $L_{R2}'$ of the saturable reactors $SR_1'$ and $SR_2'$. FIG. 20A shows the state of variation in the inductance $L_{R1}'$ of the saturable reactor $SR_1'$; FIG. 20B shows the state of variation in the inductance $L_{R2}'$ of the saturable reactor $SR_2'$; and FIG. 20C shows the vertical deflection current Iv flowing through the coils $10_{11}$, $10_{12}$, $10_{21}$ and $10_{22}$.

The variation of the inductances $L_{R1}'$ and $L_{R2}'$ of the saturable reactors $SR_1'$ and $SR_2'$ in accordance with time-dependent variation of the vertical deflection current Iv satisfies Eqs. (10), (11) and (12), and thus the impedance of the circuits of the horizontal deflecting coils $Ch_1$ and $Ch_2$ respectively vary differentially in accordance with the degree of the vertical deflection to control the currents $Ih_1$ and $Ih_2$ flowing through the horizontal deflecting coils $Ch_1$ and $Ch_2$ accordingly.

In the case of correcting misconvergence of negative crossing (FIG. 2), or in the case of correcting misconvergence of FIG. 3, a similar technique to the above may be used. In the case of correcting misconvergence of FIG. 21, in which the direction of misconvergence is identical throughout the entire area including the upper, center and lower portions of the screen, a magnetic field distribution as shown in FIG. 22 may be applied so as to shift the blue and red electron beams located on opposite sides of the green beam in a direction that the misconvergence will be corrected. Such a magnetic field distribution may be obtained by changing the magnetic bias given to the saturable reactors $SR_1'$ and $SR_2'$ so that the inductance $LR_1'$ of the saturable reactor $SR_1'$ is greater than the inductance $L_{R2}'$ of the saturable reactor $SR_2'$ from the top to the bottom of the screen to cause a greater current to flow via the upper horizontal deflecting coil $Ch_1$ than through the lower horizontal deflecting coil $Ch_2$.

Figure 21:
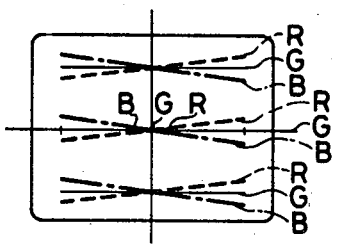
Figure 22:
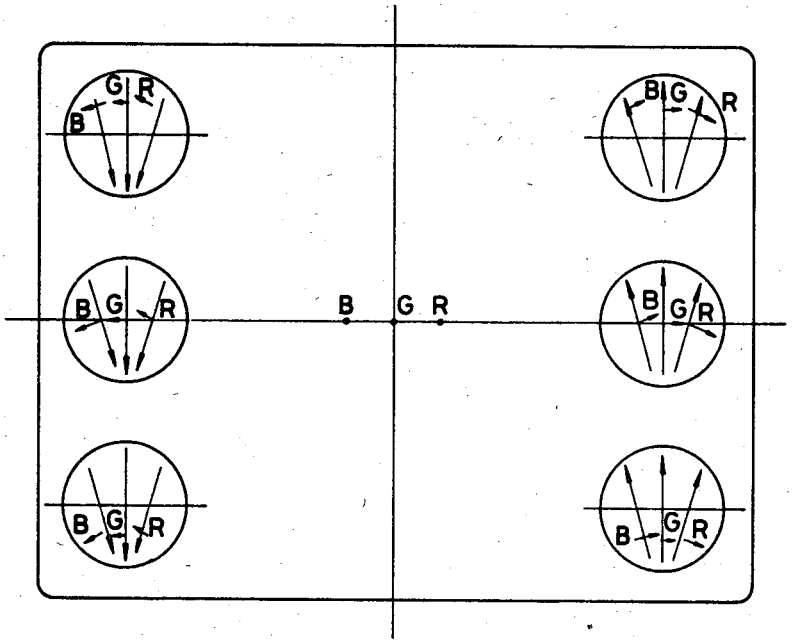
Figure 23A:
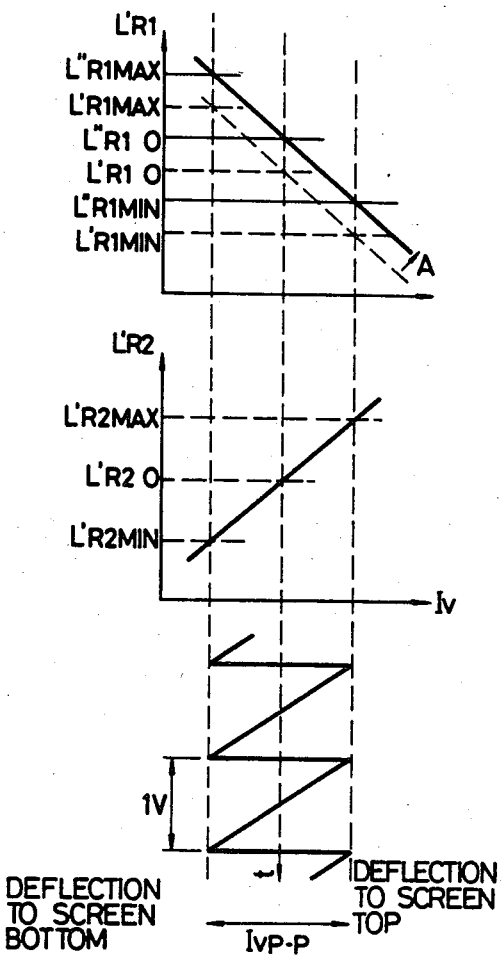
Figure 23B:
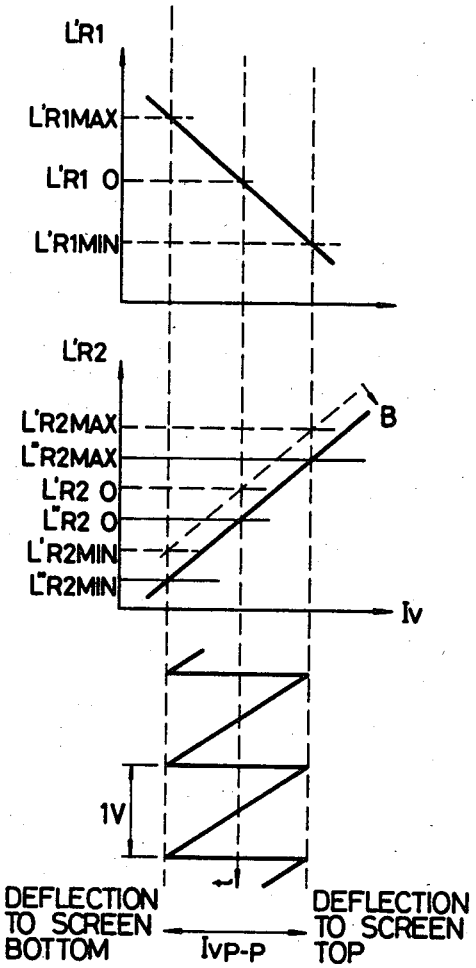
Figure 23C:
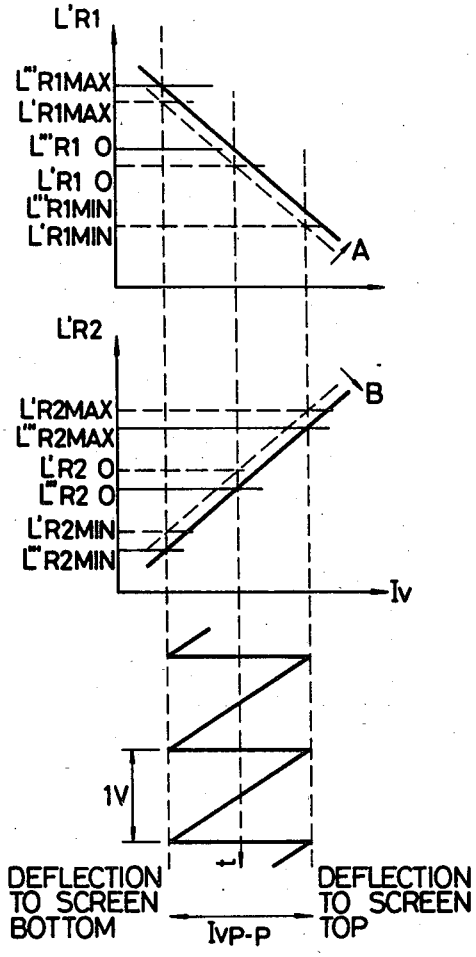

FIGS. 23A, 23B and 23C respectively show various ways for obtaining the magnetic field distribution of FIG. 22 with which misconvergence of FIG. 21 can be corrected, where each of FIGS. 23A to 23C includes graphs similar to the graphs of FIGS. 20A, 20B and 20C. FIG. 23A shows a case that the magnetic bias for the saturable reactor $SR_1'$ is made smaller so that the total inductance $LR_1'$ is shifted in the direction of an arrow A to be larger than that resulted in the absence of adjustment, so that:

$$L_{R1}''_{max}-L_{R2}'_{min}>L_{R1}'_{max}-L_{R2}'_{min}$$

$$L_{R1}''_{10}-L_{R2}'_{20}>L_{R1}'_{10}-L_{R2}'_{20}$$

$$L_{R1}''_{min}-L_{R2}'_{max}>L_{R1}'_{min}-L_{R2}'_{max}$$

FIG. 23B shows a case that the magnetic bias for the saturable reactor $SR_2'$ is made larger so that the total inductance $L_{R2}'$ is shifted in the direction of an arrow B to be smaller than that resulted in the absence of adjustment, so that:

$$L_{R1}'_{max}-L_{R2}''_{min}>L_{R1}'_{max}-L_{R2}'_{min}$$

$$L_{R1}'_{10}-L_{R2}''_{20}>L_{R1}'_{10}-L_{R2}'_{20}$$

$$L_{R1}''_{min}-L_{R2}''_{max}>L_{R1}'_{min}-L_{R2}'_{max}$$

FIG. 23C shows a case that the magnetic biases for both the saturable reactors $SR_1'$ and $SR_2'$ are adjusted so that:

$$L_{R1}'_{max}-L_{R2}''_{min}>L_{R1}'_{max}-L_{R2}'_{min}$$

$$L_{R1}'_{10}-L_{R2}''_{20}>L_{R1}'_{10}-L_{R2}'_{20}$$

$$L_{R1}''_{min}-L_{R2}''_{max}>L_{R1}'_{min}-L_{R2}'_{max}$$

Any one of these three ways may be used for obtaining the horizontal deflection magnetic field distribution shown in FIG. 22.

Figure 24:
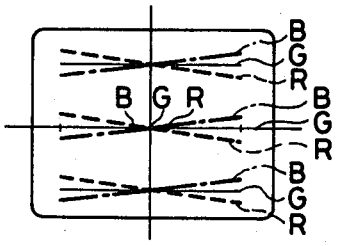

FIG. 24 shows a case in which the direction of misconvergence is opposite to that in FIG. 21. In order to correct such misconvergence the inductance $L_{R1}'$ of the saturable reactor $SR_1'$ is made smaller than the inductance $L_{R2}'$ of the other saturable reactor $SR_2'$ throughout the entire area of the screen including from the top to the bottom, namely, from the beginning of vertical scanning to the end thereof. In detail, the magnetic bias is changed so that inductance is either increased or decreased in a direction opposite to the case of FIGS. 23A to 23C, and thus misconvergence can be corrected in a similar manner to the case of FIG. 21.

In the above, although it has been simply described that the magnetic bias is changed to change the inductance of one or both of the saturable reactors $SR_1'$ and or $SR_2'$, this can be effected by changing the attaching position of the permanent magnet 19 in the axial direction of the drum core 18 of each coil assemlies 10.

Although it has been described the way of correcting typical misconvergence which are shown in FIG. 1 to 3 and in FIG. 21 and 24, other type of misconvergence, which is a combination of the above-mentioned typical examples of misconvergence, may also be satisfactorily corrected by suitably adjusting the magnetic bias of each coil assemblies 10.

In addition, the way of applying magnetic bias to the coil assemblies 10 is not limited to the use of a permanent magnet. Namely, an auxiliary winding may be provided to each drum core 18 so that a direct current is applied to the auxiliary winding to generate suitable magnetic bias. When employing such an auxiliary winding, the magnitude of the current flowing therethrough may be changed as time goes so that correction of further complex misconvergence can be effected. For instance, even if the state of misconvergence is nonsymmetrical with respect to the horizotnal center line CT, such misconvergence can be corrected by the deflecting yoke according to the present invention.

Another embodiment of the present invention will be described with reference to FIGS. 25 to 37. This embodiment is a modification of the above embodiment described with reference to FIGS. 14 to 24. Namely, this embodiment differs from the embodiment of FIGS. 16 to 19 in that a single permanent magnet is commonly used for a pair of coil assemblies for giving magnetic bias thereto, and in that the permanent magnet is movably attached so that magnitude of magnetic bias respectively applied to the pair of coils can be readily controlled.

Figure 25:
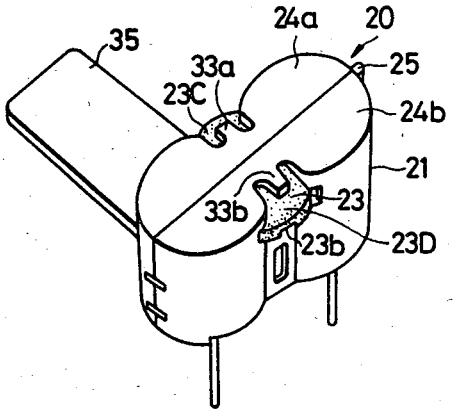
FIGS. 25 and 26 are top and bottom perspective views of a combined coil assembly which may be used in place of the pair of coils of FIGS. 16 and 17.
Figure 26:
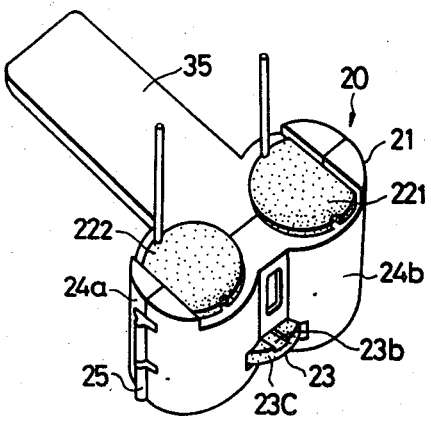
Figure 28:
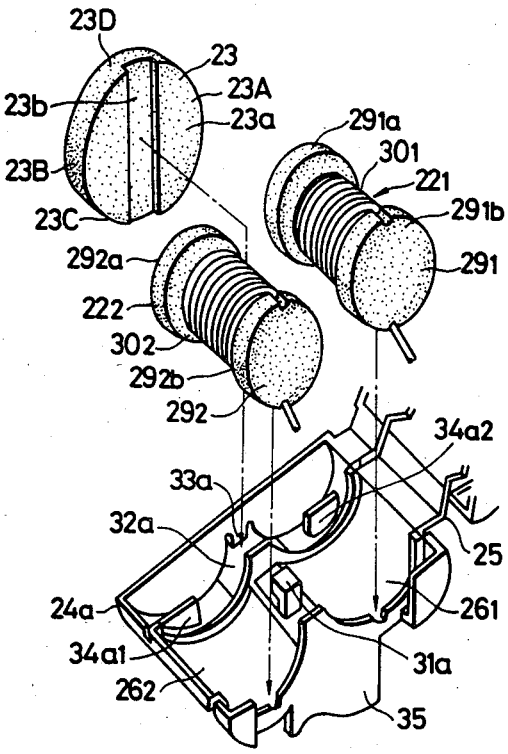
Figure 29:
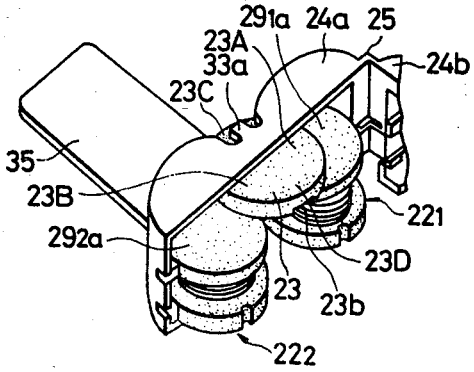
Figure 30:
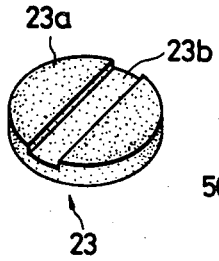
FIGS. 30, 32 and 33 show various disk-like magnets which may be incorporated into the combined coil assembly of FIGS. 25 and 26.

FIGS. 25 and 26 respectively show a top perspective view and a bottom perspective view of a combined coil assembly 20 which corresponds to the pair of coil assemblies 10 provided at each side of the cores 14 and 14' of FIGS. 16 to 18. The combined coil assembly is designated at a reference 20 and comprises a guitar-shaped coil holder or casing 21 and a pair of coils $22_1$ and $22_2$ received in the holder 21 as shown in FIGS. 28 and 29. A permanent magnet 23 is attached to one end of the coils $22_1$ and $22_2$ in such a manner that the permanent magnet 23 is in contact with both the coils $22_1$ and $22_2$.

Figure 27:
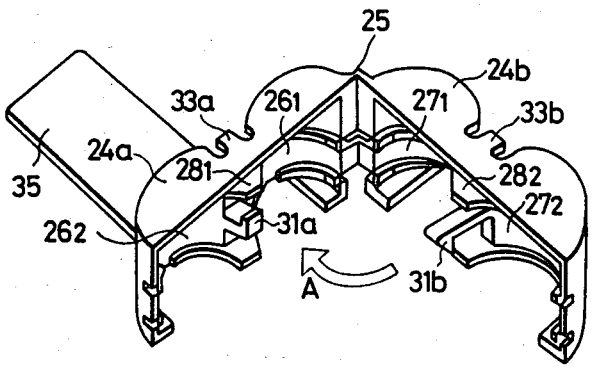
FIGS. 27 to 29 are perspective views showing the inner structure of the combined coil assembly of FIGS. 25 and 26.

As best seen in FIG. 27, the coil holder 21 has two halves 24*a* and 24*b* which are connected to each other by a hinge 35. Therefore, the holder 21 can be opened as shown in FIG. 27 and closed as shown in FIGS. 25 and 25. Each of the halves 24*a* and 24*b* of the holder 21 has two semi-cylindrical recesses $26_1$ and $26_2$ or $27_1$ and $27_2$ in such a manner that these two semi-cylindrical recesses $26_1$ and $26_2$ or $27_1$ or $27_2$ are adjacent to each other and are parallel to each other. Each of the holder halves 24*a* and 24*b* has a slot-like magnet receiving portion $28_1$ or $28_2$ for receiving a permanent magnet 23 as will be described later.

As shown in FIGS. 28 and 29, each of the coils $22_1$ and $22_2$ has a drum core $29_1$ or $29_2$, and a winding $30_1$ or $30_2$ wound around the drum core $29_1$ or $29_2$. Each of the drum cores $29_1$ or $29_2$ comprises a pair of flanges $29_{1a}$ and $29_{1b}$, or $29_{2a}$ and $29_{2b}$ at its both ends. The permanent magnet 23 has a shape of circular disk, and has poles at both sides thereof. A recess 23*b* is formed on one side of the permanent magnet 23 in such a manner that the recess extends radially in a straight line from one end to the other end of the disk along one side thereof.

As shown by dotted lines in FIG. 28, the coils $22_1$ and $22_2$ are received in the recesses $26_1$ and $26_2$ of the holder half 24*a*, and the permanent magnet 23 is received in the slot-like magnet receiving portion $28_1$. When the coils $22_1$ and $22_2$ are received in the recesses $26_1$ and $26_2$, the coils $22_1$ and $22_2$ are partially embedded and are provisionally supported in the holder half 24*a* as shown in FIG. 29. The permanent magnet 23 is also provisionally supported in the slot-like magnet supporting portion $28_1$. Under this condition, the other holder half 24*b* is rotated in a direction of an arrow A of FIG. 27 to close the holder 21 so that exposed portions of the coils $22_1$ and $22_2$ and the permanent magnet 23 are covered by the holder half 24*b*. A hook 41*a* of the holder half 24*a* is engaged with another hook 41*b* of the other holder half 24*b* so that the holder 21 is kept closed.

With this arrangement, the pair of coils $22_1$ and $22_2$ are positioned in parallel and side by side in the holder 21, while the permanent magnet 23 is placed above the flanges $29_{1a}$ and $29_{2a}$ of the coils $22_1$ and $22_2$ in such a manner that the center of the permanent magnet 23 is located at the middle of the two coils $22_1$ and $22_2$. In other words, the permanent magnet 23 is located such that its one semi-circular portion 23A faces the flange $29_{1a}$ while the other semi-circular portion 23B faces the flange $29_{2a}$. Because the permanent magnet 23 is received in the slot-like magnet receiving portions $28_1$ and $28_2$, two side portions 23C and 23D of the magnet 23 are exposed outside through an opening 42*a* of the slot-like magnet receiving portion $28_1$ and through another opening (no numeral) of the slot-like magnet receiving portion $28_2$.

The periphery of the side portions 23C and 23D may be manipulated to rotate the disk-like magnet 23 for effecting necessary adjustment as will be described later. The magnet 23 received in the slot-like magnet receiving portion $28_1$ and $28_2$ is rotatably supported therein. Namely, the magnet 23 is supported by a pair of arms 43*a* and 43*b* respectively attached to the holder halves 24*a* and 24*b* so that the magnet 23 is pressed on the flanges $29_{1a}$ and $29_{2a}$ by the elastic force of these arms 43*a* and 43*b*. As a result, a suitable friction is applied to the magnetized side 23*a* of the magnet 23 so that it is prevented from freely rotating, and thus it rotates only when an external force for rotation is applied thereto. Furthermore, the magnet 23 is held by four stoppers 33*a*1, 33*a*2 (remaining two are not shown) as shown in FIG. 28. These four stoppers 33*a*1, 33*a*2 are arranged equiangularly with respect to the center of the magnet 23 so that the periphery of the magnet 23 is in contact with these four stoppers 33*a*1, 33*a*2, and thus the radial position of the magnet 23 is defined thereby.

In the combined coil assembly 20, the pair of coils $22_1$ and $22_2$ receive magnetic bias commonly from the magnet 23 because the magnet 23 is in contact with both the coils $22_1$ and $22_2$. The windings $30_1$ and $30_2$ of the coils $22_1$ and $22_2$ are wound in opposite direction to each other, and one ends of these windings $30_1$ and $30_2$ are connected to each other.

Figure 31:
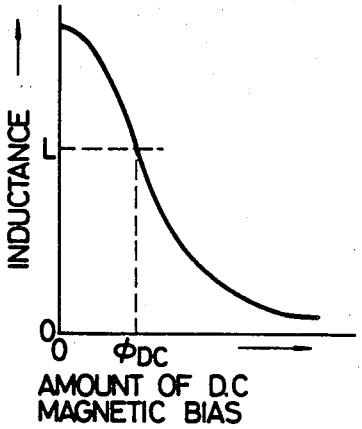
FIGS. 31 is a graph showing the inductance variation of each coil in the coil assembly of FIGS. 25 and 26.

The amount of bias respectively applied from the magnet 23 to the coils $22_1$ and $22_2$ can be changed by rotating the magnet 23. As the disk-like magnet 23 is rotated manually, the contacting area between the magnet 23 and the flange $29_{1a}$ and the other contacting area between the magnet 23 and the flange $29_{2a}$ vary because the recess 23*b* made in the center of the magnet 23 changes its direction. When the D.C. magnetic bias is changed, the inductances of the coils $22_1$ and $22_2$ vary accordingly. FIG. 31 is a graph showing the variation in inductance of the coil $22_1$ or $22_2$ caused by the change in D.C magnetic bias.

Figure 32:
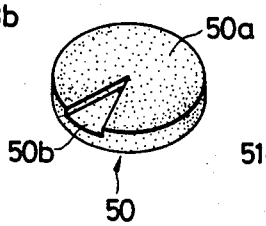
Figure 33:
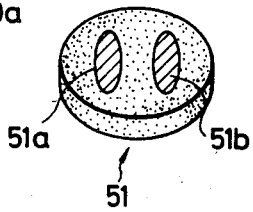

The recess 23*b* made in one side of the magnet 23 may have other shapes rather than straight-line shape. FIGS. 32 and 23 show modifications of the magnet 23. A magnet 50 of FIG. 32 has a sectoral recess 50*b* on its magnetized side 50*a*. A magnet 51 of FIG. 33 comprises two portions 51*a* and 51*b* which are partially magnetized. The magnetized portions 51*a* and 51*b* are of the same polarity, and are arranged symmetrically with respect to the center of the magnet 51.

When one of the magnets 23 and 51 is built in the coil assembly, the amount of magnetic biases respectively applied to the coils $22_1$ and $22_2$ are both changed. Namely, when the bias to one coil increases, the other bias decreases. On the other hand, when the magnet 50 of FIG. 32 is used in place of these magnets 23 and 51, the amount of magnetic bias applied to one coil can be decreased while the other amount of magnetic bias to the other coil is maintained constant.

Figure 34:
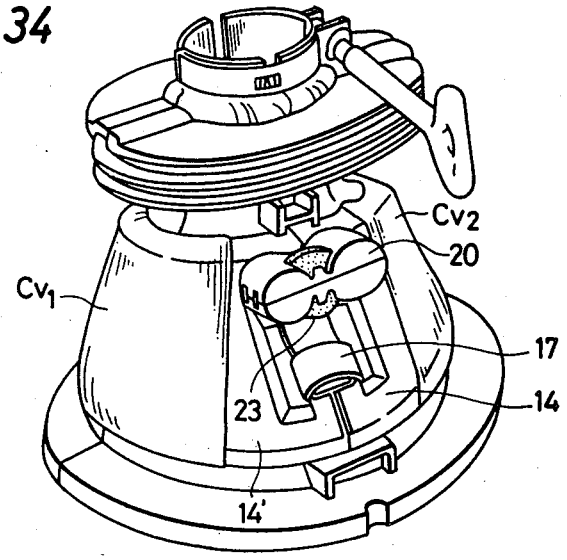
FIG. 34 is a perspective view of a deflecting yoke having the combined coil assembly of FIGS. 25 and 26.

FIG. 34 shows a deflecting yoke having the above-described combined coil assemblies (only one is shown). Each coil assembly incorporated into the deflecting yoke which substantially functions in the same manner as the pair of coils 10 of FIGS. 16 to 18 except for the fact that the amount of D.C. magnetic bias applied to the pair of coils $22_1$ and $22_2$ can be controlled simultaneously and simply by rotating the disk-like magnet 23 which is in contact with both the flanges $29_{1a}$ and $29_{2a}$ of the coil cores $29_1$ and $29_2$. Since the inductances of the coils $22_1$ and $22_2$ can be readily controlled by the rotatable magnet 23, it is possible to match the inductances with each other or to make a given difference in inductances. Consequently, it is possible to correct complex misconvergence, providing a superior convergence characteristic having fewer variations.

Although the combined coil assembly 20 described in the above can be satisfactorily incorporated into a deflecting yoke of in-line type picture tube, the combined coil assembly 20 may also be used for other purposes as will be described hereinbelow. The coils $22_1$ and $22_2$ of the combined coil assembly 20 may be commonly connected to the pair of horizontal deflecting coils $Ch_1$ and $Ch_2$ so as to change the amplitude of the horizontal deflection currents in accordance with the degree of the vertical deflection with the change in impedance. Therefore, it is possible to obtain a trapezoidal raster, which is required in a deflection unit for a color TV projector. The permanent magnet 23, 50 or 51 of the combined coil assemblies may be manipulated to adjust the impedances of the coils so as to obtain a satisfactory trapezoidal raster on a projection screen.

Figure 35:
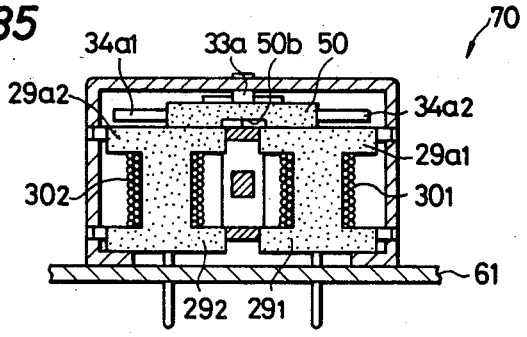
FIG. 35 is a cross-sectional view of a combined coil assembly which may be used for improving linearity in the horizontal deflection currents.

FIG. 35 shows another example of application of the combined coil assembly 20. In FIG. 35 is shown a device 70 with which the linearity of horizontal deflection currents is improved by the combined coil assembly 20. The device 70 comprises the combined coil assembly 20 which is substantially the same in construction with that described in the above. The combined coil assembly 20 is vertically attached to a printed circuit board 71 of a horizontal deflecting circuit, and comprises the permanent magnet 50 of FIG. 32.

With the device 70 it is possible to correct the waveform of the horizontal deflection current, which waveform including the beginning and ending portions of the horizontal deflection current is unsymmetrical, so that the waveform assumes a desirably correct of S-shape by rotating the permanent magnet 50. In detail, since the intensity of the magnet 50 is originally unsymmetrical with respect to its center, it is possible to change the amount of magnetic bias each given to each of the coils $22_1$ and $22_2$, and therefore, a total inductance characteristic which is unsymmetrical for the left and right halves may be obtained by using a horizontal deflection current iDY shown in FIG. 36 by means of the single magnet 50. Rotation of the magnet 50 changes the amount of magnetic bias each given to the coils $22_1$ and $22_2$ so that the ratio of A to B in FIG. 36 may be freely changed or inductances for the left and right halves may be changed.

Figure 36:
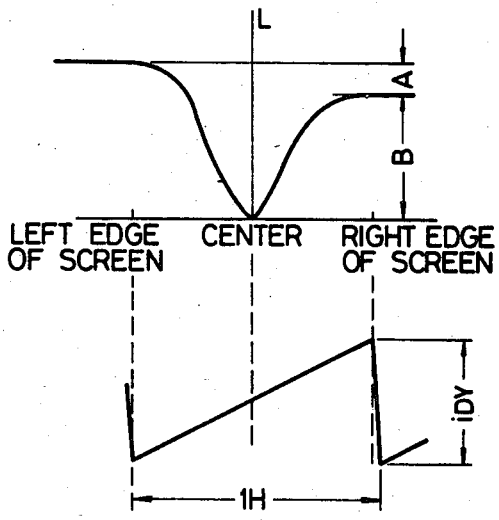
FIGS. 36, 37A to 37C and 38 are explanatory diagrams for the description of the operation of the combined coil assembly of FIG. 35.
Figure 37A:
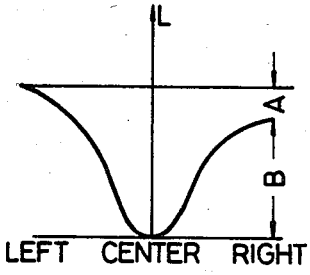
Figure 37B:
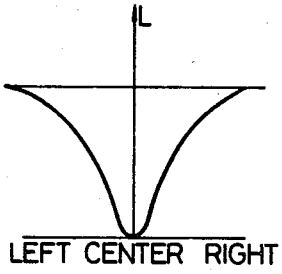
Figure 37C:
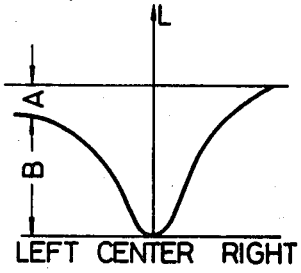
Figure 38:
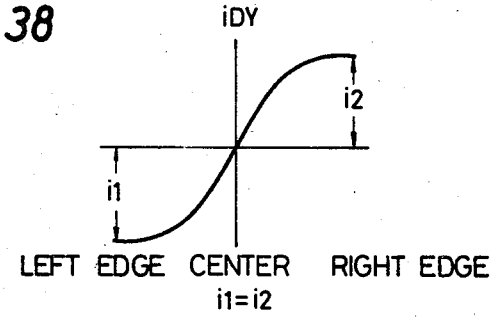

FIG. 37A shows a total inductance characteristic in which the ratio of A to B in FIG. 36 has been changed; FIG. 37B shows a characteristic in which the inductance is constant throughout the left and right halves; and FIG. 37C shows a characteristic in which the inductance in the left half is made smaller than that in the right half. Since the inductance can be freely changed in this way, it is possible to correct or compensate for the variations in the magnetic characteristics of the drum cores, variations in various constants of the deflection unit, and variations in the permanent magnet itself. As a result, it is possible to stably obtain the correct S-shaped current form of FIG. 38 irrespective of the presence of these variations.

From the foregoing description it will be understood that according to the present invention misconvergence can be corrected by changing the horizontal deflection magnetic field in accordance with the degree of the vertical deflection, and the present invention provides various advantages as follows:

(1) Although it has been difficult to obtain a satisfactory convergence characteristic and a top-and-bottom raster distortion characteristic in the conventional deflection unit, the magnetic field distribution can be suitably adjusted so that the top-and-bottom raster distortion characteristic is optimum, while misconvergence due to change in magnetic field change can be corrected by the differential current, and thus both optimum convergence characteristic and top-and-bottom raster distortion can be simultaneously obtained according to the present invention.

(2) When the coils of FIGS. 16 to 18 are used to effectively pickup the leakage flux from the vertical deflecting coils $Cv_1$ and $Cv_2$, the leakage flux, which has been unused hitherto in conventional devices, is effectively used to control the impedance of the saturable reactors. Therefore, there is no need to use coils, such as the coils Rcva and Rcvb of FIGS. 7 and 8, which are connected in series to the vertical deflection coils $Cv_1$ and $Cv_2$. Accordingly, the structure of the saturable reactors can be simplified, while it is not required to increase the power fed to the vertical deflecting coils $Cv_1$ and $Cv_2$.

Moreover, the arrangement of FIGS. 16 to 18 provides an advantage that the saturable reactors can be made small, while ringing of the horizontal deflection current which may occur when a coil of the horizontal side and a coil of the vertical side are wound on a common core, can be significantly reduced. In addition, there is no need to provide insulation between such two coils, resulting in high reliability.

(3) With the provision of the device according to the present invention, the conventional circuit for the correction of top-and-bottom raster distortion and a corrective magnet are unnecessary, while purity is not deteriorated because the conventional neck-swinging adjustment is not required. In addition no undesirable result occurs due to change in scanning frequency. From the above it will be understood that misconvergence can be effectively corrected with a fewer number of parts, while the coils additionally attached to the deflecting yoke occupy a small space. Since the device according to the present invention is simple in construction, it takes less time for designing and manufacturing, and thus manufacturing cost can be reduced, providing high-quality pictures and high reliability.

The above-described embodiments are just examples of the present invention, and therefore, it will be apparent for those skilled in the art that many modifications and variations may be made without departing from the spirit of the present invention.

What is claimed is:

1. A device for correcting an image on a picture tube for use with an in-line type color picture tube of a self-convergence system, comprising first and second saturable rectors having H-shaped, open magnetic path-type cores, the reactors respectively connected in series with the horizontal deflecting coils of the deflecting yoke having two vertical deflecting coils so that a first series circuit including a first horizontal deflecting coil and said first saturable reactor and a second series circuit including a second horizontal deflecting coil and said second saturable reactor are formed, said first and second series circuits being connected in parallel such that a horizontal deflection driving current is applied across a parallel circuit of said first and second series circuits, each of said first and second saturable reactors being arranged so that the impedance thereof changes in opposite directions in accordance with the degree of the vertical deflection effected by said vertical deflecting coils.

2. A device as claimed in claim 1, wherein each of said first and second saturable reactors comprises first and second coils wound in opposite directions to each other and connected in series, and third and fourth coils wound in a common direction and connected in series.

3. A device as claimed in claim 2, wherein the series connection of said first and second coils of said first saturable reactor is connected to one of the horizontal deflecting coils, and the other series connection of said first and second coils of said second saturable reactor is connected to the other horizontal deflecting coil.

4. A device as claimed in claim 2, wherein the series connection of said third and fourth coils of said first saturable reactor is connected to the other series connection of said third and fourth coils of said second saturable reactor so as to form a series connection of four coils.

5. A device as claimed in claim 4, wherein said series connection of said four coils is connected in series with two vertical deflecting coils of said deflecting yoke.

6. A device as claimed in claim 1, whererin each of said first and second saturable reactors comprises a pair of cores having an open magnetic path.

7. A device as claimed in claim 2, whererin each of said first and second saturable reactors comprises a pair of H-shaped cores connected coaxially.

8. A device as claimed in claim 7, wherein said H-shaped cores are magnetically biased by means of a permanent magnet.

9. A device as claimed in claim 8, wherein said permanent magnet comprises a disk-like magnet interposed between a flange of each of said H-shaped cores.

10. A device as claimed in claim 1, wherein each of said first and second saturable reactors are magnetically coupled to said vertical deflecting coils.

11. A device as claimed in claim 10, wherein each of said first and second saturable reactors comprises first and second coils wound in opposite directions to each other and connected in series.

12. A device as claimed in claim 11, wherein the series connection of said first and second coils of said first saturable reactor is connected to one of the horizontal deflecting coils, and the other series connection of said first and second coils of said second saturable reactor is connected to the other horizontal deflecting coil.

13. A device as claimed in claim 10, wherein each of said first and second saturable reactors is arranged in the vicinity of the vertical deflecting coils so as to be responsive to leakage flux from said vertical deflecting coils.

14. A device as claimed in claim 11, wherein each of said first and second saturable reactors comprises a pair of H-shaped cores around which said first and second coils are respectively wound.

15. A device as claimed in claim 14, wherein said cores of said first saturable reactor are arranged side by side so that their axes are substantially parallel to each other, and said cores of said second saturable reactor are arranged side by side so that there axes are substantially parallel to each other.

16. A device as claimed in claim 15, wherein said H-shaped cores of said first saturable reactor are attached to a toroidal core of said vertical deflecting coils in the vicinity of a connecting section of two core halves constituting said toroidal core, and wherein said H-shaped cores of said second saturable reactor are attached to said toroidal core in the vicinity of another connecting section which is opposite to said first-mentioned connecting section with respect to the center of said toroidal core.

17. A device as claimed in claim 14, wherein each of said H-shaped cores are magnetically biased by means of a permanent magnet.

18. A device as claimed in claim 17, wherein said permanent magnet is a disk-like magnet attached to said drum core.

19. A device as claimed in claim 14, wherein each pair of said H-shaped cores is magnetically biased by a single piece of a permanent magnet.

20. A device as claimed in claim 19, wherein said permanent magnet is a disk-like magnet arranged to be in conctact with one of flanges of each of said H-shaped cores.

21. A device as claimed in claim 20, wherein said magnet is rotatably supported.

22. A device as claimed in claim 21, wherein said magnet has a recess on its magnetized side.

23. A device as claimed in claim 22, wherein said recess is straight line shaped, passing through the center of said magnet.

24. A device as claimed in claim 22, wherein said recess is sector shaped.

25. A device as claimed in claim 21, wherein said magnet comprises at least two magnetized portions which are arranged symmetrical with respect to the center of said magnet.

26. A device as claimed in any one of claim 11 further comprising a coil holder having holder halves which are hinged, each of said holder halves has semi-cylindrical recesses for receiving said first and second coils therein.

27. A device as claimed in claim 26, wherein said coil holder has a magnet supporting portion so that a disk-like magnet can be rotatably held while the magnet is in contact with the flange of each core of said first and second coils.

28. A coil assembly comprising:

(a) first and second coils respectively wound around individual H-shaped, open magnetic path type cores which are adjacent each other, said first and second coils being electrically interconnected, and (b) a disc-like permanent magnet rotatably supported so that said magnet is in contact with one end of each of said cores of said first and second coils, said magnet being magnetized in the direction of its thickness, and having at least one thin portion so that rotation of said magnet causes the change in magnetic flux applied to said cores.

29. A device as claimed in claim 28, wherein said magnet has a recess on its magnetized side.

30. A device as claimed in claim 28, wherein said recess is straight line shaped, passing through the center of said magnet.

31. A device as claimed in claim 28, wherein said recess is sector-shaped.

32. A device as claimed in claim 28, wherein said magnet comprises at least two magnetized portions which are arranged symmetrically with respect to the center of said magnet.

33. A device for correcting an image on a picture tube for use with an in-line type color picture tube of self-convergence system, comprising:

(a) first and second horizontal deflecting coils;

(b) first and second vertical deflecting coils;

(c) a first saturable reactor having first and second coils connected in series in opposite directions, first and second H-shaped, open magnetic path type cores respectively provided for said first and second coils, and at least one permanent magnet for magnetizing said first and second cores in a given direction, a series circuit of said first and second coils being connected in series to said first horizontal deflecting coil so as to form a first series circuit;

(d) a second saturable reactor having third and fourth coils connected in series in opposite directions, third and fourth H-shaped, open magnetic path type cores respectively provided for said third and fourth coils, and at least one permanent magnet for magnetizing said third and fourth cores in a given direction, a series circuit of said third and fourth coils being connected in series with said second horizontal deflecting coil so as to form a second series circuit, said first and second series circuits being connected in parallel such that a parallel circuit of said first and second series circuits receives a horizontal deflection driving current;

said first and second saturable reactors being positioned diametrically with respect to a neck portion of said picture tube in the vicinity of said first and second vertical deflection coils to be magnetically coupled therewith so as to receive leakage flux from said first and second vertical deflecting coils;

the winding directions of said first through fourth coils and the polarity of said magnets of said first and second saturable reactors being selected such that the impedance of the series circuit of said first and second coils increases and decreases when the impedance of the series circuit of said third and fourth coils respectively decreases and increases in accordance with a degree of vertical deflection effected by said vertical deflecting coils.

* * * * *